US006199522B1

(12) United States Patent
Regueiro

(10) Patent No.: US 6,199,522 B1
(45) Date of Patent: Mar. 13, 2001

(54) CAMSHAFT PHASE CONTROLLING DEVICE

(75) Inventor: Jose F. Regueiro, Rochester Hills, MI (US)

(73) Assignee: DaimlerChrysler Corporation, Auburn Hills, MI (US)

( * ) Notice: Subject to any disclaimer, the term of this patent is extended or adjusted under 35 U.S.C. 154(b) by 0 days.

(21) Appl. No.: 09/384,804

(22) Filed: Aug. 27, 1999

(51) Int. Cl.[7] ..... F01L 1/34
(52) U.S. Cl. ..... 123/90.15
(58) Field of Search ..... 123/90.15, 90.17, 123/90.31, 90.34; 74/586 R

(56) References Cited

U.S. PATENT DOCUMENTS

| | | | |
|---|---|---|---|
| 4,463,712 | 8/1984 | Stojek et al. . | |
| 4,561,390 | 12/1985 | Nakamura et al. . | |
| 4,986,801 | 1/1991 | Ohlendorf et al. . | |
| 5,111,780 | 5/1992 | Hannibal . | |
| 5,355,849 | 10/1994 | Schiattino . | |
| 5,542,383 | 8/1996 | Clarke et al. . | |
| 5,673,659 | 10/1997 | Regueiro . | |
| 5,680,837 | 10/1997 | Pierik . | |
| 5,687,681 | 11/1997 | Hara . | |
| 5,860,328 * | 1/1999 | Regueiro | 74/568 R |
| 5,979,382 * | 11/1999 | Heer | 123/90.17 |

* cited by examiner

*Primary Examiner*—Teresa Walberg
*Assistant Examiner*—Vinod Patel
(74) *Attorney, Agent, or Firm*—Kenneth H. Maclean

(57) ABSTRACT

A camshaft phase controlling device which has a quill shaft extending through a hollow camshaft and has one end of the quill shaft directly connected to the drive gear with the other end of the quill shaft formed with helical splines that are connected through a connector member to straight splines formed on the inside diameter of the hollow camshaft so that axial movement of a connector member located between the helical splines and the straight splines serves to rotate the camshaft a predetermined distance upon actuation of an electric stepper motor.

16 Claims, 3 Drawing Sheets

68
70
66
54
74
14
52
58
50
24
56
104
96
98
82
80
84
64
102
48
78
76
92
100
22
62
90
60
94
11
70
72
85
86
88

CAMSHAFT PHASE CONTROLLING DEVICE

FIELD OF INVENTION

This invention relates to a valve train of an internal combustion engine and, more particularly, concerns a device for varying the timing of the opening and closing of the intake and/or exhaust valves with respect to the phase of the piston stroke.

BACKGROUND OF THE INVENTION

Applicant's U.S. Pat. No. 5,673,659 entitled "Lead Screw Driven Shaft Phase Control Mechanism", issued on Oct. 7, 1997 and assigned to the assignee of this invention, discloses a mechanism that provides a selective timing or phase adjusting system between a drive gear and a driven camshaft with the drive gear being coaxially mounted and axially affixed with respect to the driven camshaft for rotation together. An intermediate connecting member is coaxially mounted with respect to the drive gear and the camshaft and is capable of axial movement and angular movement with respect to either the camshaft or the drive gear when experiencing its relative axial movement. The intermediate connection and a coupling member are connected to a geared device that is selectively activated by an electric motor which produces axial movement of both the intermediate connection and the coupling member with respect to the camshaft and the drive gear to any desired axial position between predetermined first and second positions. The gearing device provides a unidirectional drive system which allows the electric control motor to drive the mechanism to provide the optimum shaft phasing and is operably connected to a sleeve that is axially affixed to the intermediate connecting member. When in operation, the gearing device moves the sleeve axially, which in turn, moves the intermediate member axially with respect to both the drive gear and the camshaft. The intermediate connection member is an axially shifting member that has helical splines that rotationally affix it to the camshaft to allow relative rotation of the camshaft with respect to the drive gear. In one embodiment, the gearing device drives the sleeve while in another embodiment the gearing device is a threaded lead screw engaging complementary threads formed on the sleeve. In a third embodiment disclosed in the patent, the gearing device is a part of a gear sprocket that has an internally threaded hub that engages complementary external threads on the sleeve.

In my U.S. Pat. No. 5,860,328 entitled "SHAFT PHASE CONTROL MECHANISM WITH AN AXIALLY SHIFTABLE SPLINED MEMBER", which issued Jan. 19, 1999 and assigned to the assignee of this invention, I disclose a two part variable valve timing system. In my co-pending patent application, Ser. No. 09/283,019, entitled "TWO PART VARIABLE VALVE TIMING MECHANISM", filed on Apr. 1, 1999 and assigned to the assignee of this invention, I disclose a new form of power transmission that is substituted for the threaded jackscrew system which executes the axial motion of the shifting sleeve. Inasmuch as the lowest possible friction level is desired in camshaft phase controlling devices to minimize wear and to allow use of a small electric motor for varying the position of the camshaft, it is important to have a transmission arrangement with less friction than an ACME screw. The optimum replacement for an ACME screw would be a ball-nut recirculating screw device which enjoys very low friction in operation. However, irrespective of the many advantages provided by such a device, using it for a camshaft phase controlling mechanism is not possible from a practical standpoint because the required ball-return duct would interfere with the drive gear. Accordingly, in each of the devices covered by the above-mentioned patent applications, I have incorporated into the mechanisms one of the ball-nut transmissions disclosed in my co-pending patent application, Ser. No. 09/271,229, entitled "BALL-NUT TRANSMISSION", filed on Mar. 17, 1999, and assigned to the assignee of this invention. In my co-pending DaimlerChrysler File No. 99-1420 patent application, the disclosed device differs from the device shown in my Ser. No. 09/283,019, in that the splined connection between the camshaft and the quill shaft, rather than being grouped together at one end or the other of the device are, instead, separated so that the helical spline connection is incorporated with the control assembly and the straight spline connection is incorporated with the timing drive assembly.

SUMMARY OF THE INVENTION

The present invention has one similarity to each of the devices disclosed in my aforementioned co-pending patent applications (DaimlerChrysler File Nos. 99-1419 and 99-1420) in that each device includes a form of the ball-nut transmission disclosed in my above-mentioned co-pending patent application (Ser. No. 09/271,229). However, this invention differs from each of those devices in that the quill shaft has one end rigidly connected to the drive gear while the other end of the quill shaft is formed with helical splines which act through a unique connecting member that couples helical splines encircling straight splines for providing a phase change of the camshaft relative to the drive gear of the drive assembly.

Stated broadly, the camshaft phase controlling device made in accordance with the present invention is intended for use with an internal combustion engine and includes a timing drive assembly located at one end of the engine and a control assembly located at the other end of the engine. The timing drive assembly has a drive gear adapted to be driven by the crankshaft of the engine and has a hollow camshaft that extends between the timing drive assembly and the control assembly. A quill shaft is coaxially mounted within the hollow camshaft and has a first portion located at the aforementioned one end of the engine that is connected directly to the drive gear. The quill shaft has a second portion located at the aforementioned other end of the engine and is formed at the other end with a plurality of helical splines. The hollow camshaft is formed with a cylindrical extension encircling the helical splines of the quill shaft and has its inner cylindrical surface formed with straight splines extending along the longitudinal axis of the hollow camshaft. In addition, an axially movable sleeve member surrounds the cylindrical extension of the hollow camshaft and is connected with a cylindrical connector member located between the helical splines and the straight splines. A plurality of equally circumferentially spaced pins are supported by the connector member and each of the pins serve to interconnect the helical splines with the straight splines. A nut member surrounds the sleeve member and is drivingly connected to the sleeve member through a plurality of circumferentially spaced non-recirculating balls encapsulated in the sleeve member and located in a helical groove formed in the nut member. The arrangement is such that, upon rotation of the nut member, the sleeve member and the interconnected connector member are moved axially to cause the pins to move axially along the helical splines and the straight splines to provide a phase change of the camshaft relative to the drive gear.

One object of the present invention is to provide a new and improved camshaft phase controlling device that is provided with two major parts one of which is located at the front end of an internal combustion engine and the other is located at the rear end of the engine and in which the control assembly of the device incorporates a ball-nut transmission for providing linear movement of a slidable connector member which interacts with straight splines of the camshaft and with helical splines formed on a quill shaft for changing the phase of a the camshaft.

Another object of the present invention is to provide a new and improved camshaft phase controlling device which has a quill shaft extending through a hollow camshaft and has one end of the quill shaft directly connected to the drive gear with the other end of the quill shaft formed with helical splines that are connected through a connector member to straight splines formed on the inside diameter of the hollow camshaft so that axial movement of a connector member located between the helical splines and the straight splines serves to rotate the camshaft a predetermined distance upon actuation of an electric stepper motor.

A further object of the present invention is to provide a new and improved camshaft phase controlling device incorporating a non-recirculating ball-nut transmission for linearly moving a sleeve member and in which balls are encapsulated in hemispherical cavities formed in the sleeve member which is surrounded by a nut member having a helical groove for cooperating with the balls and providing axial movement of the sleeve member and through helical splines at one end of the quill shaft and a connecting member provided with radially extending pins and attached to the sleeve member serves to interconnect the helical splines with the straight splines for angularly repositioning the camshaft relative to an engine-driven drive gear of the timing gear assembly.

BRIEF DESCRIPTION OF THE DRAWINGS

Other objects and advantages of the present invention will be more apparent from the following detailed description of the invention when taken with the drawings in which.

DETAILED DESCRIPTION OF THE INVENTION

Figure 1:
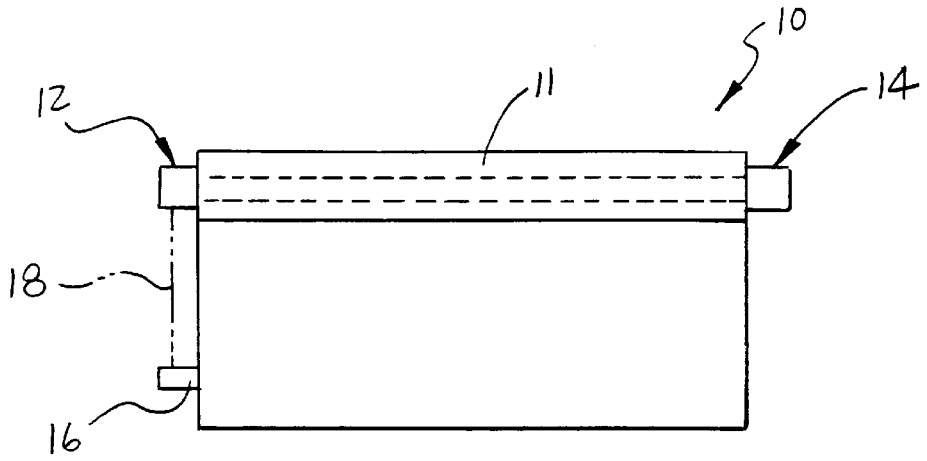
FIG. 1 is a schematic representation of the camshaft phase controlling device according to the present invention combined with an internal combustion engine with the timing drive assembly of the device located at the front end of the engine and connected to the crankshaft of the engine and with the control assembly located at the rear of the engine.

Referring to the drawings and more particularly to FIG. 1 thereof, an inline internal combustion engine 10 is shown schematically in block form as being equipped with a split or divided two-part camshaft phase controlling device made in accordance with the present invention. The camshaft phase controlling device shown is intended to be incorporated with the intake camshaft that operates a number of intake valves (not shown) disposed in the cylinder head 11 of the engine 10. It will be understood that a similar camshaft phase controlling device can control the exhaust camshaft of the engine 10.

Figure 2:
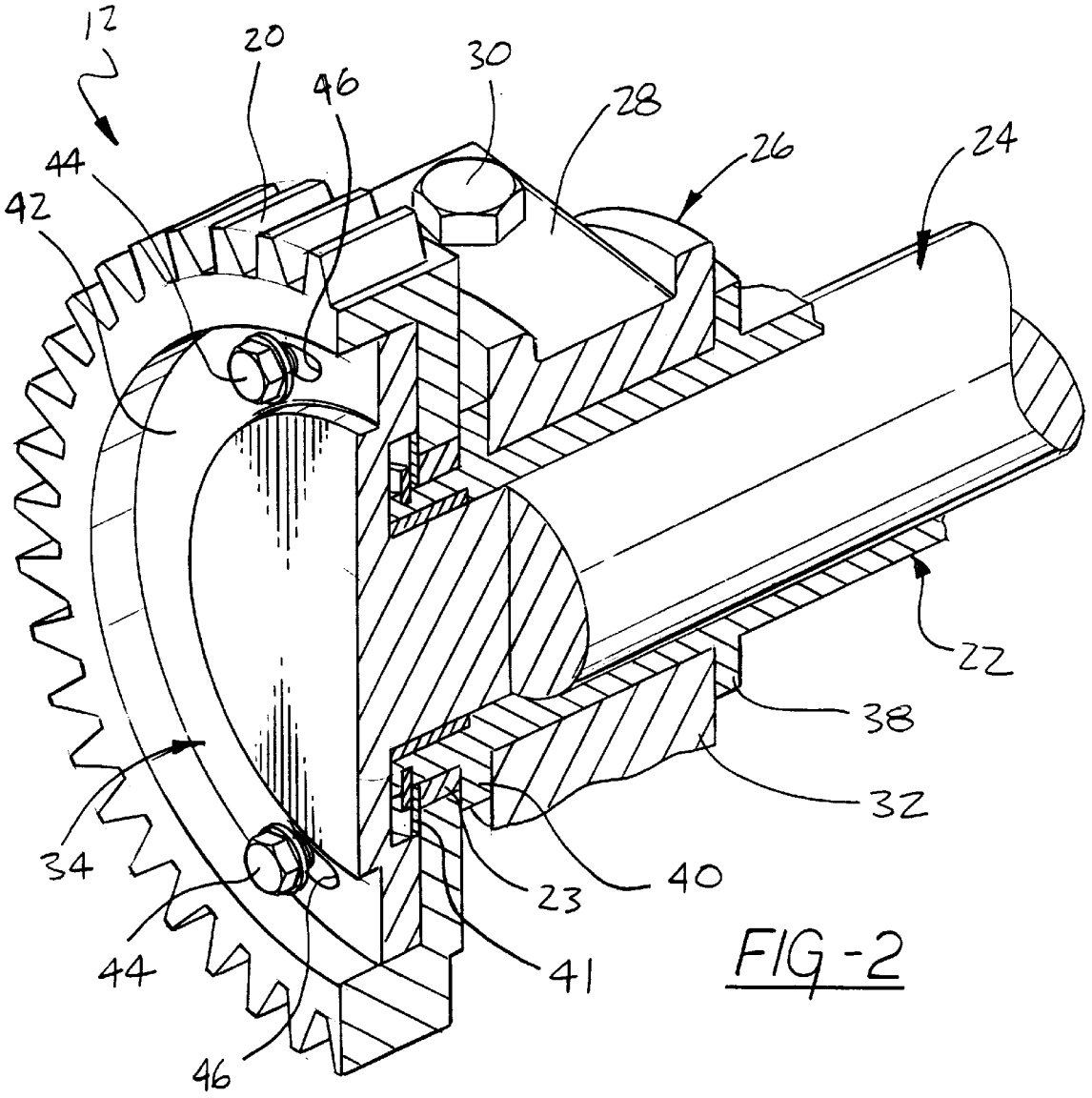
FIG. 2 is an isometric view with parts broken away and with some parts in section so as to show the various parts of the timing drive assembly of the camshaft phase controlling device according to the present invention.
Figure 3:
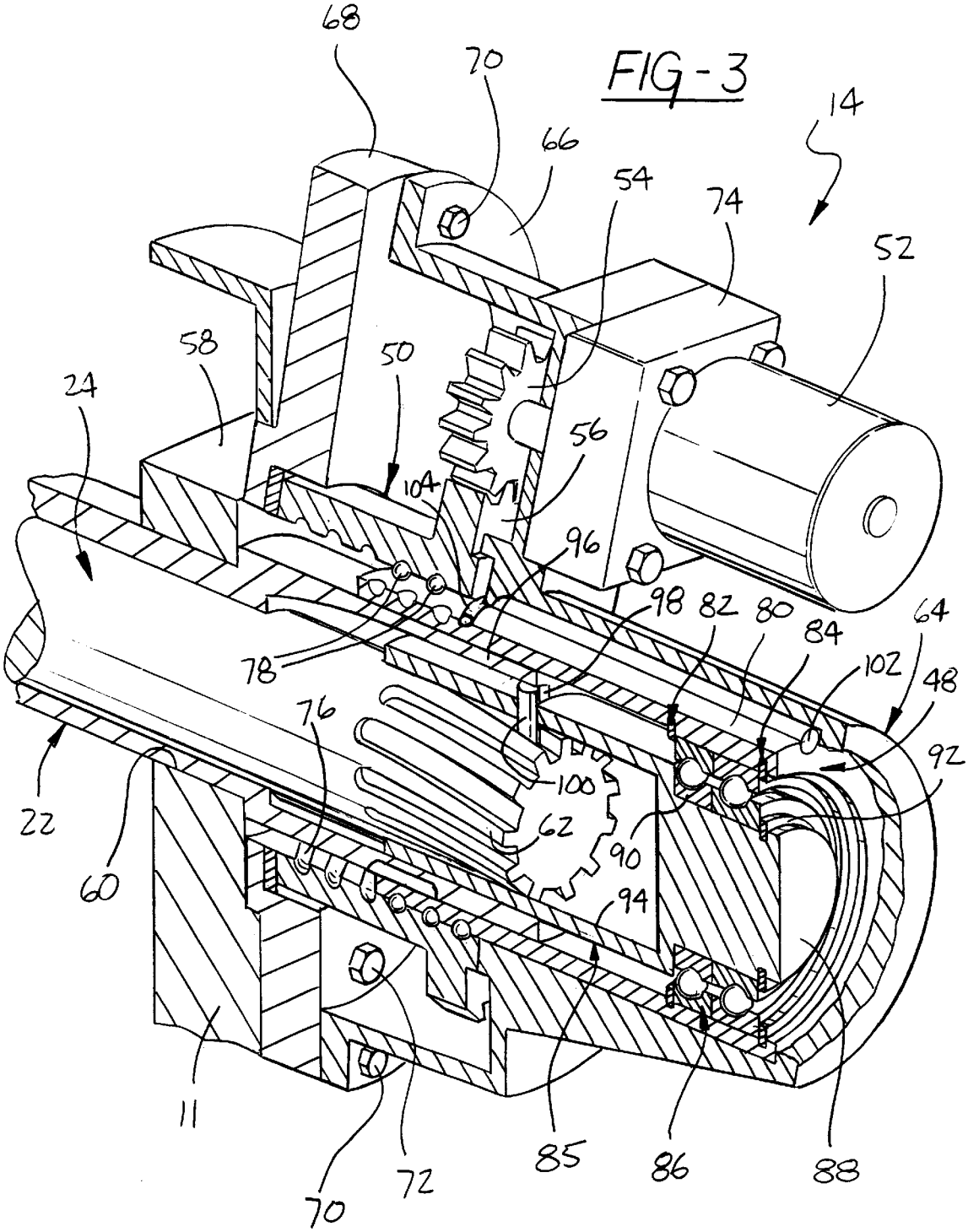
FIG. 3 is an isometric view with parts broken away and with some parts sectioned so as to show the parts of the control assembly which is a part of the camshaft phase controlling device according to the present invention.

The camshaft phase controlling device includes a timing drive assembly 12, as shown in FIG. 2, that is mounted at the front end of the engine 10 and a control assembly 14, as seen in FIG. 3, mounted at the rear of the engine 10. One reason for splitting the timing drive assembly 12 from the control assembly 12 is that in transverse engine installations, there is little space at the front timing-end of the engine, but more space at the rear end of the engine over the transaxle. Accordingly, by dividing the camshaft phase controlling device into two parts, the space available under the hood of an automobile is more efficiently utilized.

The crankshaft 16 of the engine is drivingly connected to the timing drive assembly 12 through a gearing arrangement 18 depicted, in this instance, by the dotted lines extending between the timing drive assembly 12 and the crankshaft 16. Alternatively, rather than having a direct gearing arrangement for providing drive to the timing drive assembly 12, a chain or belt drive can be used for this purpose in which case one sprocket would be connected to the crankshaft 16 and another sprocket would be a part of the timing drive assembly 12. In either case, the drive provided to the timing drive assembly 12 would be a 2:1 speed ratio.

As seen in FIG. 2, the timing drive assembly 12 includes a drive gear 20 which is operatively associated with the front portion of a hollow camshaft 22, the rear portion of which is operatively associated with the control assembly 14 seen in FIG. 3. A bearing sleeve 23 is interposed between the drive gear 20 and the front portion of the camshaft 22. An elongated and cylindrical quill shaft 24 extends through the hollow camshaft 22 and, in effect, interconnects the timing drive assembly 12 with the control assembly 14.

More specifically and as seen in FIG. 2, the front portion of the timing drive assembly 12 together with the camshaft 22 is supported for rotation by a bearing assembly 26 which includes a semi-cylindrical bearing cap 28 secured by bolts 30 (only one shown) to a bearing saddle 32 integrally formed as part of the cylinder head 11 of the engine 10. In general, the timing drive assembly 12 comprises the drive gear 20, a hub member 34 integrally formed with the front end of the quill shaft 24, and the front portion of the camshaft 22 all of which are interconnected for rotation about the longitudinal center axis of the camshaft 22. The camshaft 22 is restrained from axial movement by a pair of integrally formed and axially spaced thrust flanges 38 and 40 which abut the opposed sides of the bearing assembly 26 and are annular in configuration. In addition, the drive gear 20 is secured from axial disengagement relative to the camshaft 22 by a thrust bearing-snap ring combination 41 in which the snap ring is located in a groove formed in the front end of the camshaft 22.

The front portion of the quill shaft 24 extends through the camshaft 22 and, as mentioned above, has its front portion formed with the hub member 34. A disk-shaped portion 42 of the hub member 34 is bolted to the drive gear 20 by a plurality of circumferentially spaced bolts, two of which are only shown in FIG. 2 and identified by reference numeral 44. Each of the bolts 44 extends through a curved slot 46 formed in the circular portion of the hub member 34 so as to permit limited angular adjustment of the drive gear 20 relative to the hub member 34 upon loosening of the bolts 44.

The control assembly 14 seen in FIG. 3 is positioned at the rear of the engine 10 as seen in FIG. 1 and provides the change in timing or phasing of the camshaft 22 relative to the crankshaft 16. The control assembly 14, in general, comprises the rear portion of the quill shaft 24, the rear portion of the camshaft 22, an axially movable sleeve member 48, a nut member 50, and a stepper motor 52. The stepper motor 52 receives input pulses from an electronic control system (not shown) and is adapted to drivingly rotate the nut member 50 through a pair of gears 54 and 56.

In most engines, the timing or phase relationship between a camshaft and a crankshaft is set and is not adjustable during the operation of the engine. However, various engine related operational conditions or parameters, such as speed, load, temperature, or other operative factors, are functional factors that together relate to an ideal timing or phasing of the camshaft relative to the crankshaft. The parameters or factors are sensed by various devices and inputted as signals to an electronic control unit (ECU) which then produces an appropriate desirable output control signal in the form of control pulses that can afterwards be fed to a stepper motor 52 such as in the control assembly 14 for ideal angular phasing of the camshaft. An ECU for providing such control pulses can be seen in my aforementioned U.S. Pat. No. 5,673,659 and attention is directed to that patent for a full explanation of the manner that the stepper motor 52 of this invention receives the input pulses from an ECU.

As seen in FIG. 3, the rear portion of the camshaft 22 is supported for rotative movement by a bearing cap 58 secured by a plurality of bolts (not shown) to a bearing saddle 60 integral with the cylinder head 11 of the engine 10. The rear portion of the quill shaft 24 extends through the hollow camshaft 22 and terminates with a plurality of circumferentially and equally spaced helical splines 62. The rear portion of the quill shaft 24 and the camshaft 22 are located in a housing 64 covering the internal parts of the control assembly 14. The inner circular flange 66 of the housing 64 is secured to a plate 68 by a plurality of bolts, two of which are only shown in FIG. 3 and each is identified by the reference numeral 70. The plate 68, in turn, is secured to the cylinder head 11 by a plurality of bolts 72 ( one of which is only shown). The electric reversible D.C. stepper motor 52 is adapted to operate through a speed reducing gear set (not shown) located within a gear case 74 fastened to the housing 64 and serving to drive the gear 54 upon energization of the stepper motor 52. The gear 54 meshes with the gear 56 which is integral with the nut member 50 which serves to provide axial movement of the sleeve member 48. In this regard, the nut member 50 is cylindrical in cross section and has its inner cylindrical surface formed with a semi-circular helical groove 76 simulating a screw thread. Similarly, the sleeve member 48 is cylindrical in cross section and has a plurality of spherical balls 78 each of which is disposed in an individual hemispherical cavity 79 formed in the outer cylindrical surface of the sleeve member 48. The balls 78 are located along a helical path which matches the helical groove 76 formed in the nut member 50.

The outboard end portion 80 of the sleeve member 48 is connected through a pair of snap rings 82 and 84 to the peripheral portions of a set of angular contact ball bearings 86 which, in turn, are mounted on a connector member 85. More specifically, the bearings 86 are supported on a stub shaft portion 88 of the connector member 85 and are maintained in a fixed position relative to the stub shaft portion 88 by being positioned between a shoulder 90 and a snap ring 92 located in a groove formed in the outer end of the stub shaft 88. The stub shaft 88 is integrally formed with a tubular connector extension 94 that extends inwardly and is located between a cylindrical camshaft extension 96 and the helical splines 62 formed on the quill shaft 24. The inner cylindrical surface of the camshaft extension 96 is formed with a plurality of equally and circumferentially spaced straight splines 98 that extend parallel to the longitudinal center axis of the camshaft 22. The straight splines 98 are connected to the helical splines 62 through a plurality of circumferentially spaced cylindrical pins 100, one of which is only shown in FIG. 3. Thus, the outer cylindrical portion of each pin 100 is located in between the parallel walls of a straight spline and the inner cylindrical portion of each pin 100 is located between the walls of a helical spline. The longitudinal center axis of each of the pins 100 is located in a plane that extends perpendicular to the longitudinal center axis of the camshaft 22. Moreover, the mid-portion of each pin 100 is fixedly retained within a suitable circular opening formed in the connector member 94.

The use of the pins 100 supported by the connector extension 94 for interconnecting the helical splines 62 to the straight splines 98 over the use of a conventional double splined indexing sleeve has been chosen so as to reduce the axial length of the control assembly 14 projecting to the rear of the engine 10. If a conventional double splined design were used wherein helical splines would be formed on the inner cylindrical surface of the camshaft extension 96 for mating with the helical splines 62, a longer length of the camshaft extension 96 would be required merely to provide tool exit for the machining broach. Even if a multiple broaching operation was to be used, the camshaft extension 96 would still need to have a longer length and be more expensive to manufacture. Even if a split indexing sleeve were used with the tubular portion separate from the stub shaft portion 88 to support the bearings 86 and extend further to the rear over the length presently occupied by the stub shaft portion 88 so as to allow through broaching of the camshaft extension 96, the longer length of broached members would also increase the cost of manufacture. In such case, the stub shaft portion 88 would also require a forward extension with external helical splines formed thereon to engage the extension of the internal splines of the camshaft extension 96 and result in a more expensive design which would increase the axial length of the mechanism and subject it to the dimensional impositions of the available diameters of the commercial ball bearings. This approach could also make it more difficult to properly index all of the parts and result in minimizing the range of final adjustment of the mechanism during assembly. This would further increase the cost by forcing the indexing sleeve to be broached in a definite position.

With further reference to FIG. 3, it will be noted that the sleeve member 48 is restrained from any movement other than axial movement by three circumferentially equally spaced cylindrical keys, one of which is only shown and identified by reference numeral 102. Each of the keys 102 is disposed in radially aligned semicylindrical cavities formed in the inner cylindrical surface of the housing 64 and the outer cylindrical surface of the sleeve member 48. A circular snap ring 104 is installed in an accommodating groove on the outer cylindrical surface of the sleeve member 48 to prevent the keys 102 from moving axially relative to the housing 64 during operation of the control assembly 14 as will now be described.

The camshaft phase controlling device composed of the timing drive assembly 12 and the control assembly 14 seen in FIGS. 2 and 3 and described above operates as follows:

When the stepper motor 52 receives an input signal and pulses from the ECU calling for a phase change of the camshaft 22, the gear 54 will be drivingly rotated a predetermined amount and in a direction as dictated by the input signal and pulses. The rotation of the gear 54 will cause corresponding rotation of the nut member 50 through the gear 56. As the nut member 50 rotates about the sleeve member 48, the helical groove 76 acts through the encapsulated balls 78 to cause the sleeve member 48, together with the connector member 85, to move axially relative to the quill shaft 24 as controlled by the keys 102 interconnecting the sleeve member 48 to the housing 64. This axial movement of the connector member 85 causes the pins 100 to move along the helical splines 62 on the quill shaft 24 and simultaneously move along the straight splines 98 of the camshaft extension 96 resulting in a rotation of the camshaft 22 relative to the drive gear 16. This occurs due to the fact that the quill shaft 24 is restricted from any rotative movement by the fixed connection with the drive gear 20 of the drive assembly 12. Thus, in this manner, a phase change in the operation of the valves of the engine 10 occurs by the angular repositioning of the camshaft 22 relative to the position of the drive gear 20.

It should be noted that the sleeve member 48 connected to the nut member 50 through the helical groove 76 and the balls 78 constitutes a ball-nut transmission of the type shown in my co-pending patent application Ser. No. 09/271,229 referred to earlier in this specification. Inasmuch as the balls 78 are located in hemispherical cavities and encapsulated between the individual cavity 79 supporting each ball 78 and the helical groove 76 in the nut member 50, this ball-nut transmission provides an efficient linear movement of the sleeve member 48 with a minimum of friction and without the need for a return-duct for the balls as found in the conventional ball-nut-screw devices.

Figure 4:
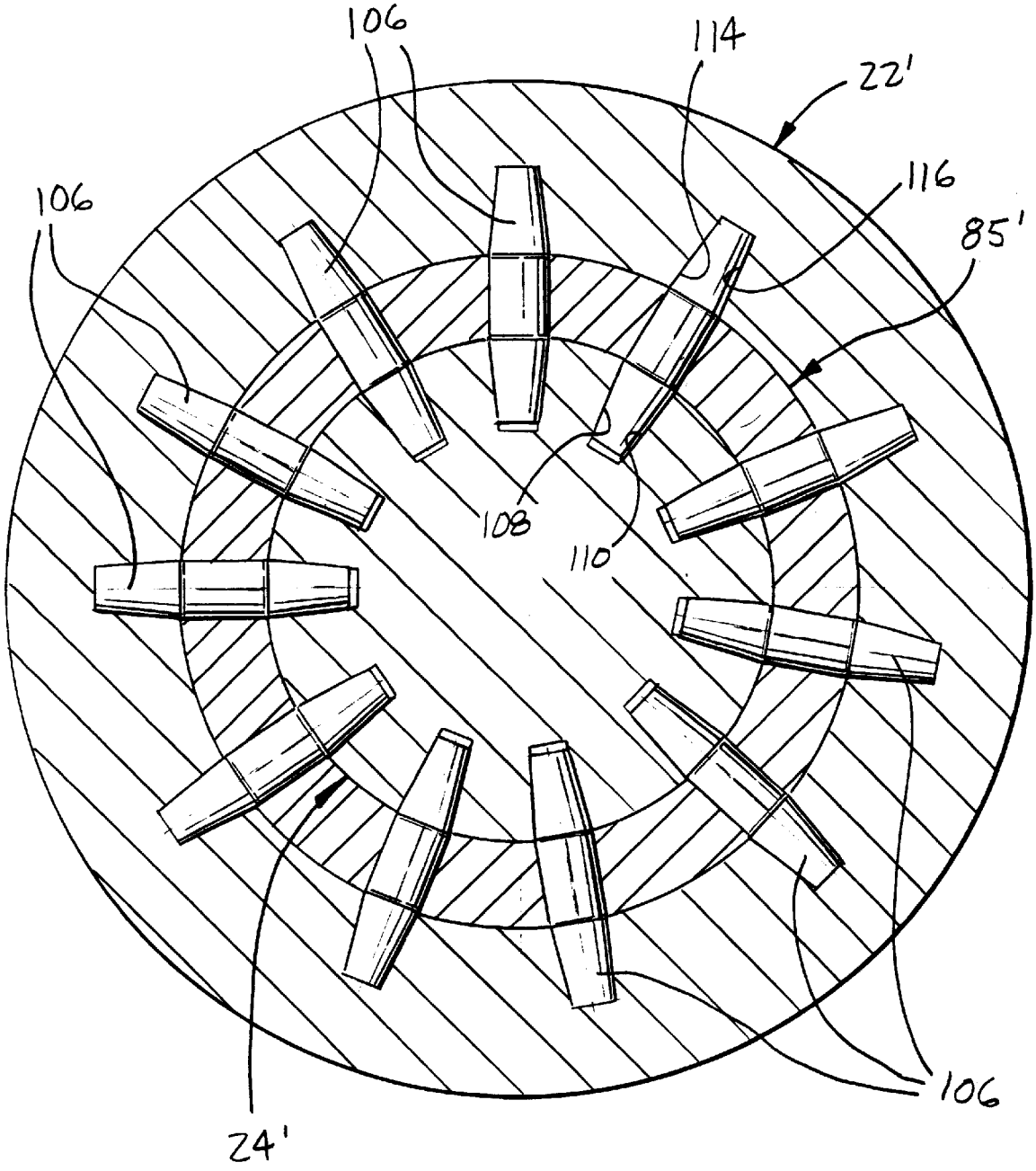
FIG. 4 is a transverse sectional view taken, as seen in FIG. 3, immediately outboard of the plurality of pins supported by the sleeve member that serve to interconnect the helical splines of the quill shaft with the straight splines of the camshaft.

FIG. 4 shows an alternative to the cylindrical pins 100 incorporated with the connector member 85 and the parallel walls of the splines 62 and 98. In this regard, it should be noted that the parts shown in FIG. 4 that correspond to parts shown in FIG. 3 are identified by identical reference numerals but primed.

With reference to FIG. 4, it will be noted that the connector member 85' is provided with a plurality of circumferentially and equally spaced pins 106 each having the opposed ends thereof taking the form of a frustum. Accordingly, in this instance, the side walls 108 and 110 of the helical splines formed with the quill shaft 24' as well as the side walls 112 and 114 of the straight splines of the camshaft 22' will be tapered to conform with the frustoconical shape of the pins 106.

Various changes and modifications can be made in the camshaft phase controlling devices described above without departing from the spirit of the invention. Such changes and modifications are contemplated by the inventor and he does not wish to be limited except by the scope of the appended claims.

What is claimed is:

1. A camshaft phase controlling device for an internal combustion engine having a crankshaft, said camshaft phase controlling device comprising:

a timing drive assembly located at one end of said engine and a control assembly located at the other end of said engine, said timing drive assembly having a drive gear adapted to be driven by said crankshaft of said engine;

a hollow camshaft extending between said timing drive assembly and said control assembly, a quill shaft coaxially mounted within said hollow camshaft and having a first portion located at said one end of said engine and being connected to said drive gear, said quill shaft having a second portion located at said other end of said engine and being formed with a plurality of helical splines, said hollow camshaft being formed with a cylindrical extension encircling said helical splines and having its inner cylindrical surface formed with straight splines extending along the longitudinal axis of said hollow camshaft;

an axially movable sleeve member surrounding said cylindrical extension of said hollow camshaft and being formed with a cylindrical connector member located between said helical splines and said straight splines;

a plurality of equally circumferentially spaced pins supported by said cylindrical connector member, each of said pins serving to interconnect said helical splines with said straight splines; and a nut member surrounding said sleeve member and being drivingly connected to said sleeve member through a plurality of circumferentially spaced non-recirculating balls encapsulated in said sleeve member and located in a helical groove formed in said nut member so that, upon rotation of said nut member, said sleeve member and said cylindrical connector member are moved axially to cause said pins to move axially along said helical splines and said straight splines to provide a phase change of said camshaft relative to said drive gear.

2. A camshaft phase controlling device for an internal combustion engine having a crankshaft, said camshaft phase controlling device comprising:

a timing drive assembly located at one end of said engine and a control assembly located at the other end of said engine, said timing drive assembly having a drive gear adapted to be driven by the crankshaft of said engine;

a hollow camshaft extending between said timing drive assembly and said control assembly;

a quill shaft coaxially mounted within said hollow camshaft and having a first portion located at said one end of said engine and being connected to said drive gear through an adjustable connection, said quill shaft having a second portion located at said other end of said engine and being formed with a plurality of helical splines, said hollow camshaft being formed with a cylindrical extension encircling said helical splines and having its inner cylindrical surface formed with straight splines facing said helical splines and extending along the longitudinal axis of said hollow camshaft;

an axially movable sleeve member surrounding said cylindrical extension of said hollow camshaft and being connected with a cylindrical connector member a portion of which is located between said helical splines and said straight splines;

a plurality of equally circumferentially spaced pins supported by said cylindrical connector member, each of said pins having its outer end located in the groove portion of said straight splines and having its inner end located in the groove portion of said helical splines; and a nut member surrounding said sleeve member and being drivingly connected to said sleeve member through a plurality of circumferentially spaced non-recirculating balls encapsulated in said sleeve member and located in a helical groove formed in said nut member so that, upon rotation of said nut member said sleeve member and said cylindrical connector member are moved axially to cause said pins to move axially along said helical splines and said straight splines to provide a phase change of said camshaft relative to said drive gear.

3. The camshaft phase controlling device of claim 2, wherein each of said pins is located along a plane extending transversely to the longitudinal center axis of said quill shaft.

4. The camshaft phase controlling device of claim 3, wherein said plane is perpendicular to said longitudinal center axis of said quill shaft.

5. The camshaft phase controlling device of claim 2, wherein an electric stepper motor forms a part of said control assembly for rotating said nut member and causing axial movement of said sleeve member and said connector member.

6. The camshaft phase controlling device of claim 5, wherein the outer circumference of said nut member is formed with gear teeth which mesh with the gear teeth of a pinion driven by said stepper motor.

7. The camshaft phase controlling device of claim 6, wherein said sleeve member is restrained from rotating about its longitudinal center axis by a plurality of circumferentially spaced roller keys located between said sleeve member and the housing of said control assembly.

8. The camshaft phase controlling device of claim 2, wherein said sleeve member is connected to said connector member through a bearing means which allows rotative movement of said connector member while said pins move along said helical splines.

9. The camshaft phase controlling device of claim 2, wherein the opposed ends of each of said pins is cylindrical in configuration and the accommodating splines have parallel side walls.

10. The camshaft phase controlling device of claim 2, wherein the opposed ends of each of said pins is frustoconical in configuration and the accommodating splines have tapered side walls.

11. The camshaft phase controlling device of claim 2, wherein said first portion of said quill shaft is integrally formed with a hub member which is connected to said drive gear through said adjustable connection.

12. The camshaft phase controlling device of claim 11 wherein said hub member is formed with a plurality of arcuate slots through each of which extends a bolt for providing said adjustable connection.

13. A camshaft phase controlling device for an internal combustion engine having a crankshaft, said camshaft phase controlling device comprising:

a timing drive assembly located at one end of said engine and a control assembly located at the other end of said engine, said timing drive assembly having a drive gear adapted to be driven by the crankshaft of said engine;

a hollow camshaft extending between said timing drive assembly and said control assembly;

a quill shaft coaxially mounted within said hollow camshaft and having a first portion located at said one end of said engine and being connected to said drive gear through an adjustable connection, said quill shaft having a second portion located at said other end of said engine and being formed with a plurality of helical splines, said hollow camshaft being formed with a cylindrical extension encircling said helical splines and having its inner cylindrical surface formed with straight splines facing said helical splines and extending along the longitudinal axis of said hollow camshaft, an axially movable sleeve member surrounding said cylindrical extension of said hollow camshaft, a cylindrical connector member connected to said sleeve member for axial movement therewith and having a portion thereof located between said helical splines and said straight splines, bearing means interposed between said sleeve member and said connector member so as to allow rotative movement of said connector member relative to said sleeve member, a plurality of equally circumferentially spaced pins supported by said cylindrical connector member, each of said pins having its upper end located in the groove portion of said straight splines and having its lower end located in the groove portion of said helical splines, a nut member surrounding said sleeve member and being drivingly connected to said sleeve member through a plurality of circumferentially spaced non-recirculating balls each of which is encapsulated between a hemispherical cavity formed in said sleeve member and a helical groove formed in said nut member so that, upon rotation of said nut member, said sleeve member and said cylindrical connector member are moved axially to cause said pins to move axially along said helical splines and cause rotative movement of said connector member through said straight splines to angularly rotate said camshaft and provide a phase change of said camshaft relative to said drive gear, and an electric stepper motor forming a part of said control assembly for rotating said nut member and causing axial movement of said sleeve member and said connector member.

14. The camshaft phase controlling device of claim 13, wherein said connector member includes a stub shaft integrally formed with a tubular extension supporting said pins.

15. The camshaft phase controlling device of claim 14, wherein said sleeve member is connected to said stub shaft through bearing means.

16. The camshaft phase controlling device of claim 13, wherein said control assembly includes a housing and said sleeve member is limited to axial movement by key means interposed between the outer surface of said sleeve member and the inner surface said housing.

* * * * *